US009476662B2

(12) United States Patent
Fischer et al.

(10) Patent No.: US 9,476,662 B2
(45) Date of Patent: Oct. 25, 2016

(54) SILENCER FOR A LONG GUN

(71) Applicant: Andreas Steindl, Tulln (AT)

(72) Inventors: Oliver Fischer, Dornbirn (AT); Christian Loitz, Lochau (AT)

(73) Assignee: Andreas Steindl, Tulln (AT)

( * ) Notice: Subject to any disclaimer, the term of this patent is extended or adjusted under 35 U.S.C. 154(b) by 0 days.

(21) Appl. No.: 14/584,257

(22) Filed: Dec. 29, 2014

(65) Prior Publication Data

US 2015/0184968 A1 Jul. 2, 2015

Related U.S. Application Data

(63) Continuation of application No. PCT/EP2012/062616, filed on Jun. 28, 2012.

(51) Int. Cl.
*F41A 21/34* (2006.01)
*F41A 21/30* (2006.01)

(52) U.S. Cl.
CPC ..... *F41A 21/30* (2013.01)

(58) Field of Classification Search
CPC ..... F41A 21/30; F41A 21/325; F41A 21/34; F41A 21/32; F41A 21/26
USPC ..... 89/14.2–14.4; 181/223
See application file for complete search history.

(56) References Cited

U.S. PATENT DOCUMENTS 2,935,000 A * 5/1960 Mowrey ..... F41A 21/325 89/14.3
3,710,679 A * 1/1973 Werbell, III ..... F41A 21/30 89/14.4
5,092,223 A * 3/1992 Hudson ..... F41A 21/38 89/14.2
5,356,183 A * 10/1994 Cole ..... F16L 25/0045 285/148.27
5,596,161 A * 1/1997 Sommers ..... F41A 21/34 89/14.2
5,679,916 A * 10/1997 Weichert ..... F41A 21/30 181/223
5,773,746 A * 6/1998 Vaden ..... F41A 21/325 181/223
D415,812 S * 10/1999 Andrews, Jr. ..... D22/100
6,374,718 B1 * 4/2002 Rescigno ..... F41A 21/30 89/14.4
6,385,891 B1 5/2002 Rabatin
6,412,389 B2 * 7/2002 Fluhr ..... F41A 21/30 181/223
6,837,139 B2 * 1/2005 Meyers ..... F41A 21/34 42/77
6,948,415 B2 * 9/2005 Matthews ..... F41A 21/325 42/1.06
D577,409 S * 9/2008 Brittingham ..... D22/108
D577,410 S * 9/2008 Brittingham ..... D22/108
7,661,349 B1 2/2010 Brittingham
7,735,406 B1 6/2010 Olson (Continued)

FOREIGN PATENT DOCUMENTS

DE 42 31 183 C1 3/1994
DE 198 15 467 A1 10/1999
DE 10 2005 005 595 A1 8/2006

OTHER PUBLICATIONS

International Search Report with Written Opinion for International Application PCT/EP2012/062616, mailed Mar. 21, 2013.

*Primary Examiner* — Michael David
(74) *Attorney, Agent, or Firm* — Myers Wolin, LLC

(57) ABSTRACT

A silencer for a firearm, in particular, an assault rifle or another long gun, is provided. The silencer can be fitted onto a barrel of the firearm, wherein a muzzle brake is fixed to the barrel and wherein the muzzle brake can be fixed to the silencer by a releaseable connection, such as a screw connection.

9 Claims, 3 Drawing Sheets

(56) References Cited

U.S. PATENT DOCUMENTS

| | | | | |
|---|---|---|---|---|
| 7,854,085 | B1 * | 12/2010 | Hodgkins | F41A 21/32 42/85 |
| 8,091,462 | B2 * | 1/2012 | Dueck | F41A 21/325 42/76.01 |
| 8,196,701 | B1 * | 6/2012 | Oliver | F41A 21/30 181/223 |
| 8,201,487 | B2 * | 6/2012 | Dueck | F41A 21/26 42/96 |
| 8,291,805 | B1 * | 10/2012 | Quilligan | F41A 21/325 285/305 |
| D677,357 | S * | 3/2013 | Dueck | D22/108 |
| 8,424,441 | B2 * | 4/2013 | Brittingham | F41A 21/26 181/223 |
| D682,972 | S * | 5/2013 | Kasanjian-King | D22/108 |
| 8,516,941 | B1 * | 8/2013 | Oliver | F41A 21/30 181/223 |
| 8,555,765 | B2 * | 10/2013 | Graham, II | F41A 21/325 285/92 |
| 8,763,510 | B2 * | 7/2014 | Dueck | F41A 21/26 89/14.4 |
| 8,790,434 | B1 * | 7/2014 | Oliver | B01D 39/00 181/223 |
| 8,973,481 | B2 * | 3/2015 | Dueck | F41A 21/325 181/223 |
| D737,396 | S * | 8/2015 | Paganis | D22/108 |
| 9,103,618 | B2 * | 8/2015 | Daniel | F41A 21/325 |
| D738,982 | S * | 9/2015 | Silvers | D22/108 |
| 9,151,560 | B2 * | 10/2015 | Myers | F41A 21/30 |
| 9,182,188 | B2 * | 11/2015 | Gawencki | F41A 21/30 |
| 2006/0060076 | A1 * | 3/2006 | Dueck | F41A 21/30 89/14.4 |
| 2007/0137084 | A1 * | 6/2007 | Laney | F41A 3/18 42/51 |
| 2008/0156183 | A1 * | 7/2008 | Brittingham | F41A 21/325 89/14.4 |
| 2008/0302598 | A1 * | 12/2008 | Nicolai | F01N 1/003 181/254 |
| 2011/0197487 | A1 | 8/2011 | Humston | |

* cited by examiner

SILENCER FOR A LONG GUN

CROSS REFERENCE TO RELATED APPLICATIONS

The present application is a continuation of International Application No. PCT/EP2012/062616, filed on Jun. 28, 2012, the contents of which are incorporated herein by reference.

FIELD OF THE INVENTION

The invention relates to a silencer for a firearm, a firearm with a silencer according to the invention, as well as a method for mounting a silencer according to the invention on a firearm.

BACKGROUND OF THE INVENTION AND PRIOR ART

The term "firearms" designates long guns which in contrast to pistols comprise a muzzle brake.

Such firearms also include all kinds of weapons, as e.g., rifles, blow/hack operated weapons, or gas operated weapons, pump action rifles, and assault rifles.

The invention will be described by means of the example of an assault rifle of the brand "Steyr AUG 77/A", although the present invention is not limited to the latter.

It is known to equip firearms with a silencer, wherein such a silencer either is screwed onto the end of the gun barrel, or it is as for the MP5 SD or the AWS an inherent part of the weapon.

The silencer exclusively reduces the sound emission, which emanates during a gunshot from the highly pressurized gases expanding explosively from the muzzle. The mechanical noises of a possibly existing reload automatism and the loud bullet report from the projectiles, which are fired with supersonic speed, on the other hand remain unaffected.

Further, the silencer also suppresses the muzzle flash such that there are advantages during night missions when using night observation devices.

For example, it is known from DE 10 2005 005 595 A1, DE 198 15 467 A1, or DE 42 31 183 C1, to screw a silencer onto the screw thread at the front end of the gun barrel of the weapon, A plurality of firearms are equipped with a muzzle brake, as, in particular, it is known for an assault rifle "Steyr AUG 77".

The muzzle brake is a device at the barrel of such firearms, which uses the energy of combustion gases to reduce blowback of the barrel. Muzzle brakes mostly are used with automatic cannons and artillery pieces, more rarely, however, with firearms.

The muzzle brake consists in a known manner from one or more deflector plates mounted in front of the pipe outlet, which are fixedly connected to the pipe. The deflector plates have an opening for allowing a bullet to pass through, the diameter of which is 1.1 of the bullet gauge.

Immediately after the bullet has left the pipe, the pressurized combustion gases of the propellant exit from the pipe, and thereby, partially collide with the deflection plates of the muzzle brake. They are deflected perpendicular or even slightly bent backwards by the deflection plates, and thereby transfer a part of their energy to the muzzle brake, and thereby to the barrel. The energy of the combustion gases acting in the shooting direction, due to the collision with the muzzle brake, counteracts to the blowback directed backwards and reduces the latter.

Up to now it is not known to additionally equip firearms, which have a muzzle brake with the properties mentioned above, with a silencer.

Object of the Invention

Therefore, the invention is based on the object to further develop a firearm having a muzzle brake of the type mentioned above such that the silencer may be fixed thereto.

Solution According to the Invention

For solving the object mentioned above, the invention is characterized by the technical teaching of claim 1.

An essential feature of the invention is that now, the muzzle brake fixed to the barrel can be connected to the silencer by means of a screw connection.

This is a new type of connection, because up to now it has not been possible to directly connect muzzle brakes to a silencer by means of a screw connection. Up to now, the muzzle brake has been disassembled, and thereafter, the silencer has been mounted, or the use of a silencer was not possible at all.

This is where the invention starts, which allows for an easily releasable connection between the muzzle brake and a silencer to be attached thereto by means of the screw connection according to the invention.

Hereby, it is advantageous, if the muzzle brake in the area of its front end has an annular base, which forms an internal thread, which cooperates with an external thread of a threaded sleeve of the silencer screw connection.

It is advantageous, if the bushing forming the outer casing of the silencer with radial connection walls is connected to an inner pipe casing directed in a longitudinal axial direction, at the front end of which the threaded sleeve is arranged with the external thread facing towards the axial direction.

According to a preferred embodiment of the invention, the inner pipe casing of the silencer encloses the muzzle brake completely.

This threaded sleeve having an external thread arranged approximately in the middle region of the silencer cooperates with the interior thread at the front end of the muzzle brake, and forms the screw connection according to the invention.

By this, there is the advantage that the muzzle brake is received in an elongated longitudinal bore of the silencer, whereby a tilt-free guidance and fixation of the muzzle brake in the interior of the silencer is ensured.

A further advantage is that in the area of this longitudinal bore, the explosion gases being discharged from the muzzle brake are received within cross bores evenly distributed at the circumference, which communicate with the expansion chamber arranged at the outer circumference of the longitudinal bore in an air conducting manner, which receive these explosion gases.

Further, it is essential that this explosion chamber communicates with a further gas chamber being adjacent thereto in axial direction in an air conducting manner, and the air conducting connection results from longitudinal bores being arranged in the connection wall, which separates the expansion chamber from the gas chamber adjacent thereto in axial direction.

Thereby, the gases accumulated in the expansion chamber have to flow through the longitudinal bores in the connection wall in axial direction of the silencer under expansion, and thereafter flow into the adjacent gas chamber.

Hereby, it is preferred that a number of ring blades being parallel with respect to each other and forming a mutual distance are arranged, which in between form expansion spaces.

Thereby, an excellent silencing effect and a suppression of the explosion gases entering there are achieved.

The subject-matter of the present invention not only results from the subject-matter of the single claims, but rather also from the combination of the single claims with each other.

All statements and features disclosed in the documents, including the abstract, in particular, the spatial arrangement illustrated in the drawings, are claimed as being essential to the invention, as far as they are novel over the prior art individually or in combination.

BRIEF DESCRIPTION OF THE FIGURES

In the following, the invention is explained in further detail by means of only one embodiment. Hereby, further features essential to the invention and advantages of the invention can be derived from the figures and their description in which.

DETAILED DESCRIPTION OF THE INVENTION

Figure 1:
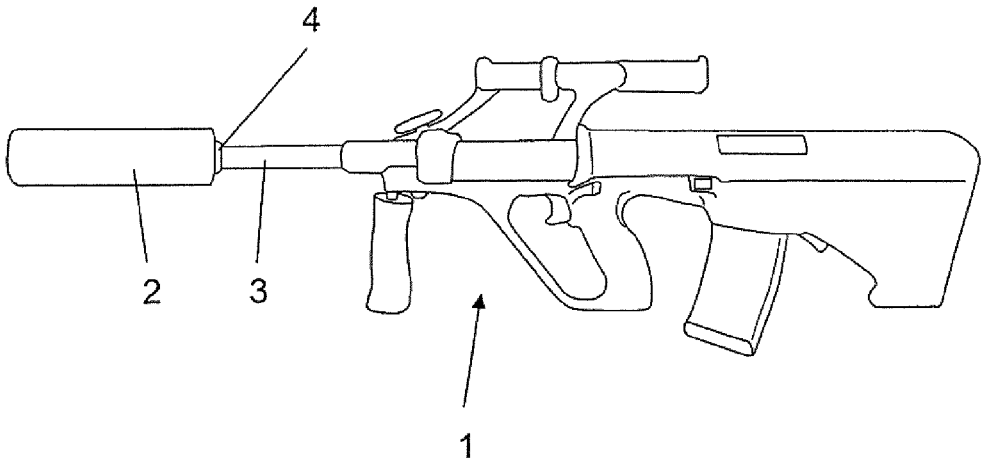
FIG. 1 shows a side view of an assault rifle with a silencer according to the invention mounted thereto.

In FIG. 1, an assault rifle is illustrated as blowback operated firearm 1, on the barrel 3 of which a muzzle brake 4 is fixed, which is connected to a silencer 2. The muzzle brake 4 may be connected fixedly to the barrel 3. Alternatively, the muzzle brake 4 may also connected to the barrel 3 releasably, for example by means of a thread.

Figure 2:
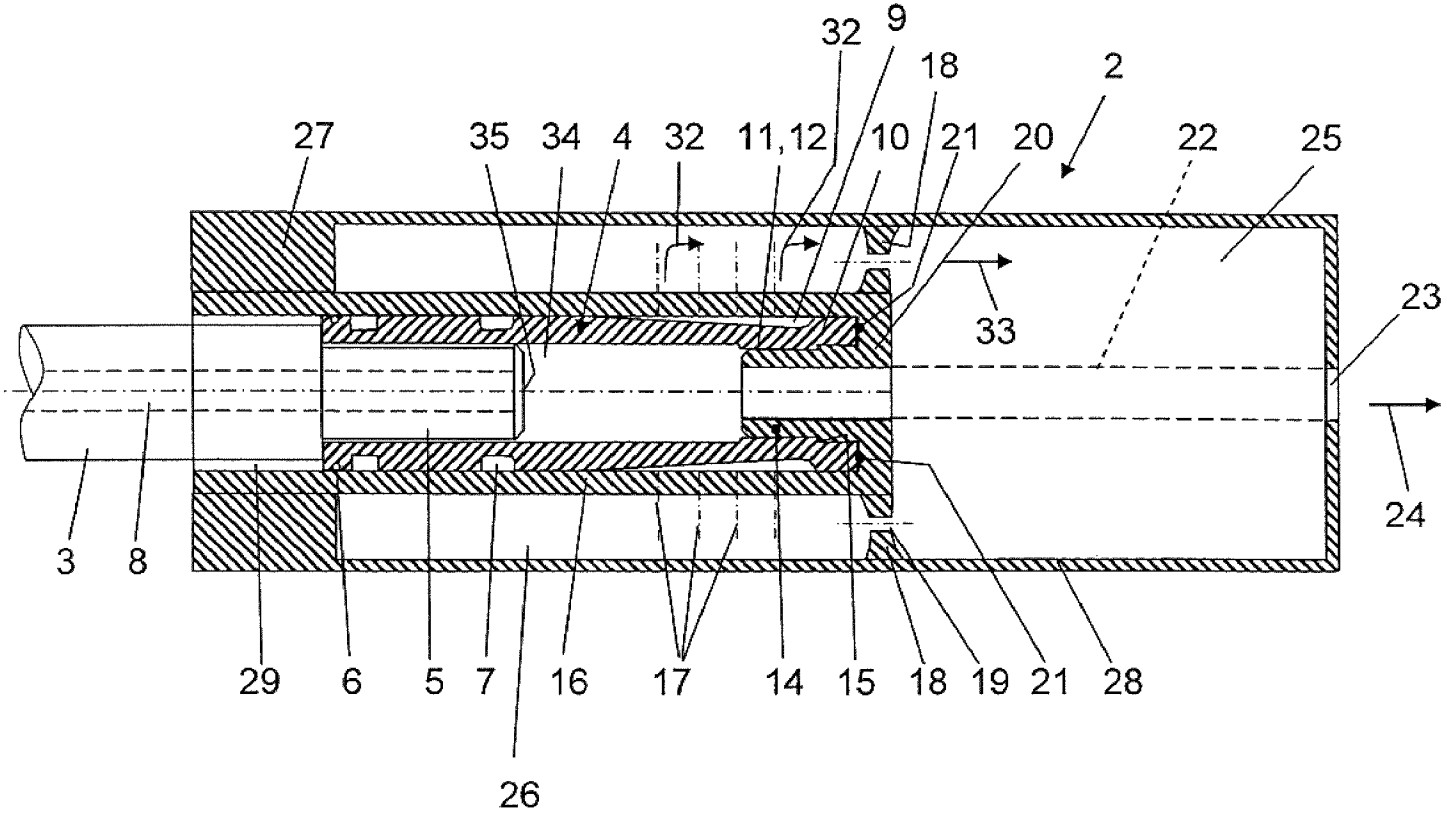
FIG. 2 shows a section through a silencer according to the invention in a state fixed to a muzzle brake.
Figure 3:
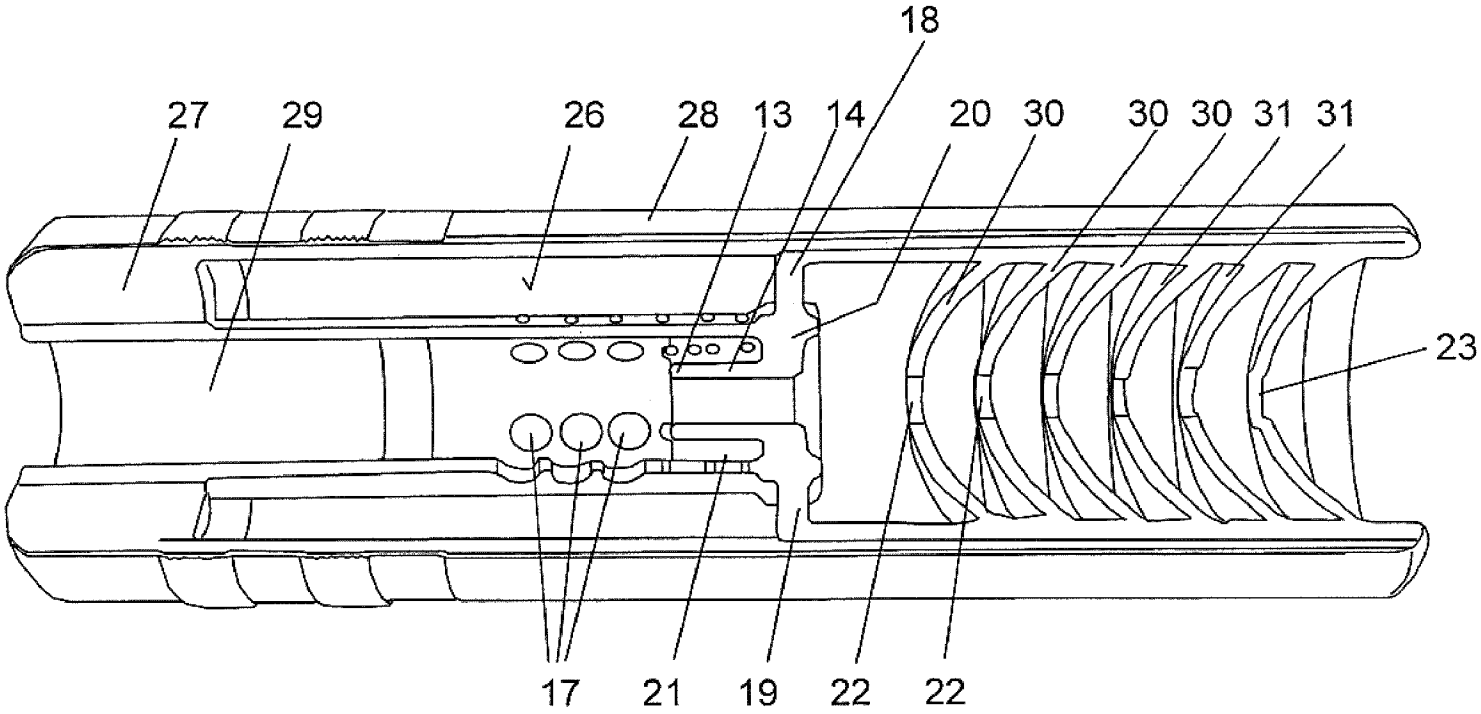
FIG. 3 shows a section through the silencer of FIG. 2 with its barrel and muzzle brake removed.

From FIG. 2 and FIG. 3 further details of the fixation can be derived.

As can be seen in FIG. 2, at the front side of the barrel 3 there is arranged a muzzle brake 4, whereby the barrel 3 forms a thread base 5 having an external thread, and to which the muzzle brake 4 is screwed.

The backwards sealing of the muzzle brake results from a snap ring 6, and further, there are annular grooves 7, into which suitable sealing rings may be inserted.

The muzzle brake 4 in the front region forms a series of slots 9 evenly distributed in circumferential direction, through which the explosion gases may exit to the exterior radially. Instead of the slots 9, the muzzle brake may also comprise a number of bores, through which the explosion gases may also exit to the exterior.

Further, the front end of the muzzle brake 4 is formed by an annular base 10, which forms an annular stop 15, and which has an internal thread 12 as part of the thread connection 11 according to the invention.

The muzzle brake 4, thus, is inserted into the receiving bore 29 of the silencer 2 extending in axial direction, whereby an excellent tilt-free guidance is ensured according to FIG. 2.

The longitudinal bore 8, which forms the shot channel in the barrel 3, thus leads to the interior space of the muzzle brake 4 according to FIG. 2.

The silencer 2 now is fitted on the muzzle brake 4 and is pushed until the external thread 13 of a threaded sleeve 14 arranged in the inner space of the silencer 2 abuts against the internal thread 12 of the muzzle brake 4.

In this case, only about 8 revolutions of the silencer 2 on the muzzle brake 4 are enough in order to ensure that the annular base 10 of the muzzle brake abuts within the receiving space 21 of the silencer in the area of the connection wall 20, and the annular stop 15 at the same time prevents a further screwing in.

The threaded sleeve 14 according to the invention is part of the inner space of the silencer 2, and is connected to a pipe casing 16 arranged in the silencer inner space via a connection wall 20.

The connection wall 20 in turn is already integrally formed with a threaded sleeve 14 from one material.

Further, the connection wall 20 preferably continues integrally via a further connection wall 18 made from the same material to the inner circumference of the bushing 28 of the silencer 2.

The pipe casing 16 having a reduced diameter with respect to the outer bushing 28 is connected to the bushing 28 at its rear end via a bushing part 27 preferably integrally and made from one material.

The silencer 2 may also be designed as two parts, wherein a first part is formed by the threaded sleeve 14, the connection wall 20, and the pipe casing 16, and the second part is formed by the bushing 28, the connection wall 18, and the bushing part 27. The connection of the first part to the second part may result from a screw connection in the area of the bushing part 27, wherein an internal thread is provided at the bushing part 27, and an external thread corresponding to the internal thread is provided at the rear end of the pipe casing 16. For the two-piece embodiment it is possible, to firstly fix the first part at the muzzle brake 4, and to subsequently screw the second part onto the first part. Moreover, with respect to the two-part embodiment, the production of the silencer according to the invention can be facilitated.

According to the two-piece configuration of the silencer according to the invention, different materials may be provided for the two parts. The first part, for example, may be made from a metal 1. The second part may, for example, be made from a composite material, for example, carbon fiber reinforced plastics. Thereby, on the one hand, the weight of the silencer can be substantially reduced without negatively affecting the stability.

The two-part configuration of the silencer is possible for all embodiments of the invention shown here.

During generation of the explosion gases directly at the muzzle 35 of the barrel 3, these explosion gases enter into the inner space 34 of the muzzle brake 4 and exit via the slots 9 or via the bores in radial direction via a number of cross bores 17, which penetrate through the pipe casing 16.

Thereby, a direction reversal of the explosion gases is effected, which are diverted in arrow direction 32 after flowing into the expansion chamber 26, and which flow in arrow direction 33 through longitudinal bores 19 assigned thereto in the radial connection wall 18.

Thus, they enter in arrow direction 33 into the gas chamber 25 linked to the expansion chamber 26 in an air conducting manner.

The shot channel 22 passes through this gas chamber 26 and leads to the outlet opening 23 of the silencer 2, where the bullet exits from the silencer in arrow direction 24.

The slots 9 or the bores in the muzzle brake 4 may at least partially correspond to or be flush with the cross bores 17 of the silencer such that an essentially unimpeded escaping of the explosion gases from the inner space 34 of the muzzle brake 4 is enabled.

In the embodiment according to FIG. 2, it is not mentioned in which manner the gas chamber 25 is formed.

The installations arranged there may be formed according to different shapings.

As preferred embodiment, an integration of ring blades 30 according to FIG. 3 is shown.

These ring blades are wall bodies formed approximately semi-circular, which are interspersed in their middle section by the shot channel 22.

The shot channel 22, hereby, is formed as boring through the ring blades 30.

Each ring blade 30 in connection with the adjacent or further ring blade which is spaced apart forms an expansion space 31 such that a number of expansion spaces 31 is formed in the gas chamber 25, which brings about an interference elimination and a calming of the explosion gases.

Due to the use of the silencer according to the invention it now is no longer necessary to disassemble the muzzle brake prior to use of the silencer, but rather according to the invention, the possibility is offered for the first time to directly fix the muzzle brake in the inner space of the silencer via a screw connection.

By means of the present invention it is also possible to design a firing cup, for example, a grenade firing cup, an auxiliary barrel, or a laser attachment such that the latter may be fixed to the muzzle brake releasably.

REFERENCE NUMERALS

1 blowback operated weapon
2 silencer
3 barrel
4 muzzle brake
5 thread base
6 snap ring
7 annular groove
8 longitudinal bore (shot channel)
9 slot
10 annular base
11 threaded connection
12 internal thread (of 4)
13 external thread (of 14)
14 threaded sleeve
15 annular stop
16 pipe casing
17 cross bores
18 connection wall
19 longitudinal bore
20 connection wall (of 4)
21 receiving space (of 2)
22 shot channel
23 outlet opening (of 2)
24 arrow direction
25 gas chamber
26 expansion chamber
27 bushing part
28 bushing (of 2)
29 receiving bore
30 ring blade
31 expansion space
32 arrow direction
33 arrow direction
34 inner space
35 outlet

The invention claimed is:

1. A silencer for a firearm (1), which is configured to fit onto a barrel (3) of the firearm (1), comprising a muzzle brake (4) that is fixed to the barrel (3), which can be fixed to the silencer (2) releasably by a screw connection (11, 12, 13), wherein the muzzle brake (4) has an annular base (10) in the area of a front end of the muzzle brake, which forms an internal thread (12), which cooperates with an external thread (13) of a threaded sleeve (14) of the silencer (2) as the screw connection (11), and wherein a bushing (28) forming an outer casing of the silencer (2) is connected with radial connection walls (18, 27) to an inner pipe casing (16) aligned in a longitudinal axial direction, at the front end of which the threaded sleeve (14) is arranged with the external thread (13) being directed in the axial direction.

2. The silencer of claim 1, wherein the threaded sleeve (14) at the inner pipe casing (16) of the silencer (2) forms an annular stop (15) for the annular base (10) of the muzzle brake (4).

3. The silencer of claim 1, wherein the inner pipe casing (16) of the silencer (2) encloses the muzzle brake (4) radially, preferably completely.

4. The silencer of claim 1, wherein the inner pipe casing (16) of the silencer (2) has a number of cross bores (17) arranged side by side spaced apart from each other, which lead into an expansion chamber (26) in an air conducting manner, which are arranged between an external circumference of the pipe casing (16) and an internal circumference of the external bushing (28).

5. The silencer of claim 1, wherein an outlet area of the inner pipe casing (16) leads into a gas chamber (25) being enlarged in diameter, which is arranged in a front part of the silencer (2) within the bushing (28).

6. The silencer of claim 1, wherein a number of ring blades (30) being formed parallel with respect to each other and being spaced apart from each other are arranged, which in between form expansion spaces (31).

7. The silencer of claim 1, wherein a rear expansion chamber (26) running in axial direction is connected to a front gas chamber (25) in an air conducting manner via longitudinal bores (19) in a front connection wall (18).

8. A firearm (1), in particular, assault rifle, with a muzzle brake (4) fixed to a barrel (3) of the firearm, and with a silencer (2), in particular, according to claim 1, wherein the silencer (2) can be connected to the muzzle brake (4), preferably releasably, by means of connection means, preferably a screw connection (11, 12, 13).

9. A method for mounting a silencer (2) to a barrel (3) of a firearm (1) being provided with a muzzle brake (4), wherein the muzzle brake (4) is inserted into an inner receiving bore (29) of the silencer (2) running in a longitudinal direction, until the front part of the muzzle brake (4) abuts against a threaded sleeve (14) of the silencer (2) being directed longitudinally, and that thereafter, the silencer (2) is screwed by means of a number of revolutions onto the muzzle brake (4).

* * * * *